United States Patent [19]

Mori et al.

[11] Patent Number: 4,725,917

[45] Date of Patent: Feb. 16, 1988

[54] CURRENT LIMITING HORN DEVICE FOR TRANSMISSION LINE

[75] Inventors: Sadao Mori, Yotsukaido; Yoshio Hasegawa, Kasugai; Takashi Irie, Kani, all of Japan

[73] Assignee: NGK Insulators, Ltd., Japan

[21] Appl. No.: 740,428

[22] Filed: Jun. 3, 1985

[30] Foreign Application Priority Data

Jun. 9, 1984 [JP] Japan ..... 59-118640

[51] Int. Cl.[4] ..... H01T 14/00

[52] U.S. Cl. ..... 361/132; 361/127; 361/137; 361/138

[58] Field of Search ..... 361/127, 132, 137, 138, 361/112, 117

[56] References Cited

U.S. PATENT DOCUMENTS

| | | | |
|---|---|---|---|
| 1,477,304 | 12/1923 | Allcutt | 361/138 |
| 2,246,303 | 6/1941 | Hodnette | 361/132 X |
| 4,308,566 | 12/1981 | Imataki et al. | 361/132 X |
| 4,326,233 | 4/1982 | Yamabu et al. | 361/127 |

OTHER PUBLICATIONS

Technical Report (Part I), No. 76, "Outline of Insulator Design for Overhead Transmission Line", Japanese Electrical Society, Oct. 1966.

*Primary Examiner*—J. R. Scott
*Assistant Examiner*—Derek S. Jennings
*Attorney, Agent, or Firm*—Parkhurst & Oliff

[57] ABSTRACT

A current limiting horn device for a transmission line supported by sets of insulators suspended from arms of steel towers. The device includes horns located respectively at charging and earthing portions of each set of the insulators and spaced horizontally apart a predetermined distance from a vertical axis of the set of the insulators. At least one of the horns is provided with an arrester element of a resistance having a non-linearity. According to the invention, a ratio Z/Zo of a distance Z between the horns to a total length Zo of the one set of insulators is not more than 0.5, thereby when extraordinary voltage caused by lightening surge is applied to the transmission line, securely causing flash-over between horns to prevent any earthing accident which would otherwise occur in the transmission line.

4 Claims, 8 Drawing Figures

CURRENT LIMITING HORN DEVICE FOR TRANSMISSION LINE

BACKGROUND OF THE INVENTION

1. Field of the Invention

This invention relates to a current limiting horn device for a transmission line.

2. Description of the Prior Art

Recently, an arrester element, mainly made of zinc oxide crystallized at high temperatures to have an appropriate non-linearity, has been developed and applied to arresters for substations. In order to prevent lightening stroke accident on transmission lines, moreover, an arrester insulator having an arrester element sealed in a porcelain tube or an arrester insulator integrally formed only with an arrester element is also being investigated. Furthermore, a current limiting horn which is a combination of an arrester element and an arcing horn of an insulator for power transmission is being studied.

With the arrester insulator above described, when the arrester element is out of order or a creeping short-circuit occurs along insulators, a charging portion and a steel tower are short-circuited resulting into an earthing accident. In this case, it becomes impossible to effect the power transmission until the arrester insulator is electrically disconnected from the power transmission system. Furthermore, a steady state voltage is being applied to the arrester insulator, so long as the transmission line is operative. In order to maintain the electrical characteristics of the arrester element to an acceptable level in spite of its deterioration due to ageing and ensure the long life of the element, therefore, the arrester element is required to be enough long.

On the other hand, with the current limiting horn above described, even if an earthing accident occurs due to the arrester element being out of order, it is possible again to start the power transmission without disconnecting the arrester element from the power transmission system with particular means. Moreover, as voltage is not normally applied to the arrester element, all that causes its deterioration is only the lightening surge current, so that its long life can be expected even if its length is short.

In order to guard a transmission line against the earthing accident with the aid of current limiting horns, however, it is absolutely necessary to cause flash-over between the current limiting horns when being subjected to lightening stroke so as to avoid flash-over along a set of insulators or between conductor and a steel tower. It is therefore required to suitably select mounting positions (coordinates) of the current limiting horns.

Moreover, it is needed for the current limiting horns to take a particular precaution because the zinc oxide applicable to the current limiting horn has a high resistance prior to its operation against the lightening surge voltage to exhibit characteristics different from those of metallic arcing horns used in the prior art insulators.

In more detail, referring to FIG. 1 illustrating a current limiting horn device for a transmission line, a steel tower 1 has an arm 2 from which are hanged a set of insulators 3 for supporting the transmission line 4. The set of insulators 3 comprise at a charging portion a current applicable side horn 5 and at an earthing portion an earthing side current limiting horn 6 using an arrester element 7 mainly made of zinc oxide. When a lightening stroke voltage is applied to the transmission line 4 to cause flash-over, the flash-over passage can be classified into four cases shown in FIGS. *2a, 2b, 2c* and *2d*. Among these cases, the flash-over passage as shown in FIG. *2a* exhibits a sufficient current limiting effect. In the cases shown in FIGS. *2b–2d*, however, the current limiting effect cannot be expected and in earthing accident cannot be avoided.

SUMMARY OF THE INVENTION

It is a principal object of the invention to provide an improved current limiting horn device for a transmission line, which eliminates all the disadvantages of the prior art and which when extraordinary voltage caused by lightening surge is applied to the transmission line, securely causes flash-over between horns to prevent any earthing accident which would otherwise occur in the transmission line.

In order to accomplish this object, in a current limiting horn device for a transmission line supported by sets of insulators suspended from steel towers, said device including horns respectively arranged at charging and earthing portions of each set of said insulators and spaced horizontally apart a predetermined distance from a vertical axis of the set of said insulators, at least one said horn being provided with an arrester element of a resistance having a non-linearity, according to the invention a ratio Z/Zo of a distance Z between said horns to a total length Zo of the one set of insulators is not more than 0.5.

In a preferred embodiment, a distance X between the vertical axis of the insulators and tip ends of the horns is in a relation $0.15Zo \leqq X \leqq 0.35Zo$.

The invention will be more fully understood by referring to the following detailed specification and claims taken in connection with the appended drawings.

Figure 3:
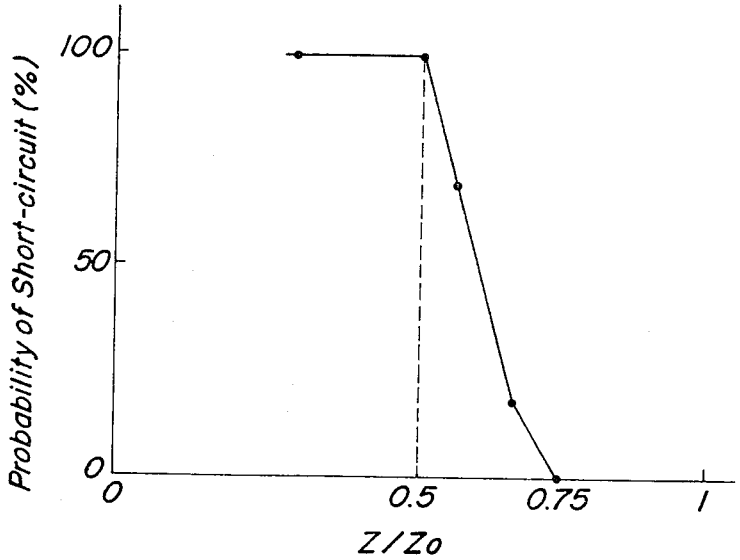
Figure 4:
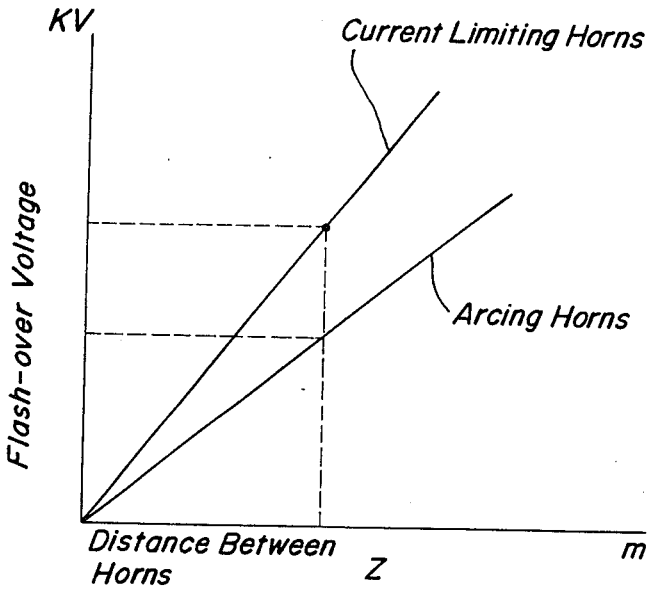
Figure 5:
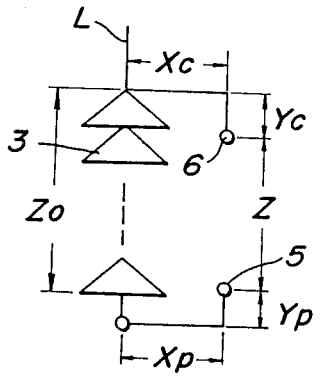

FIGS. *2a, 2b, 2c* and *2d* are schematic front elevations illustrating various conditions of flash-over of the current limiting horn device;

FIG. 3 is a graph illustrating a relationship between a ratio of distance of horns to total length of insulators and probability of short-circuit of horns;

FIG. 4 is a graph showing a relationship of distance between horns to critical flash-over voltage; and FIG. 5 is a schematic view illustrating positions or coordinates of a current limiting horn device.

DETAILED DESCRIPTION OF THE PREFERRED EMBODIMENT

Figure 1:
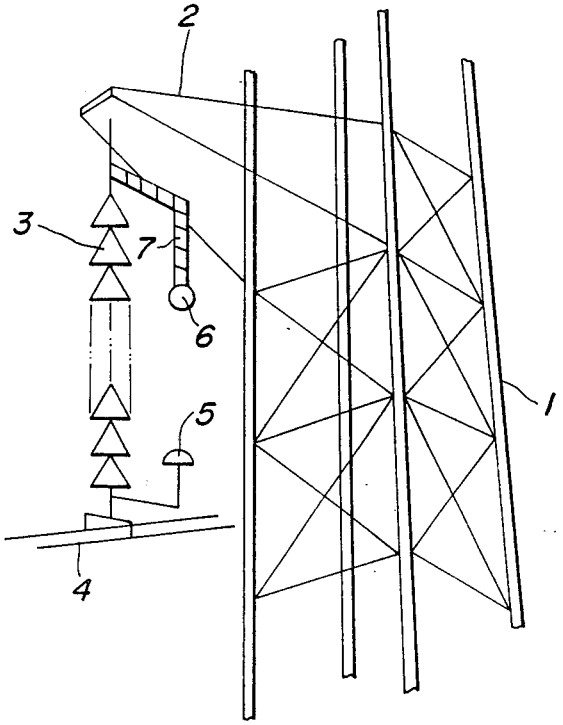
FIG. 1 is a perspective view of one embodiment of a current limiting horn device for a transmission line according to the invention.

Referring to FIG. 1 illustrating the current limiting horn device for the transmission line, it is advantageous to set a ratio Z/Zo as small as possible in order to increase critical flash-over voltage, where Zo is a total length of a set of the suspended insulators and Z is a distance between the horns 5 and 6. This holds true in the arcing horns as well as the current limiting horns. However, if the ratio Z/Zo is small, the flash-over between the horns 5 and 6 occurs frequently, thereby promoting the deterioration of arrester elements owing to the lightening surge current to shorten the life of the current limiting horns. It is required therefore to increase the critical flash-over voltage and the ratio Z/Zo.

The inventors investigated the critical flash-over voltage when predetermined voltages were applied to current limiting horns whose distances Z therebetween were changed and sets of insulators whose total lengths Zo were constant to obtain results shown in FIG. 3. As can be seen from the results, the ratio Z/Zo should be less than 0.5 in order to obtain 100% probability of the flash-over between the current limiting horns.

Although the ratio Z/Zo less than 0.5 increases somewhat the frequency of the flash-over between the current limiting horns, such an increase of the frequency is only 20% in comparison with prior art arcing horns having the same shape and size and the same lightening stroke flash-over voltage characteristics as those of the currrent limiting horns 6 having zinc oxide arrester elements (FIG. 4). Accordingly, the increase of the frequency or possibility of the flash-over is not significant.

FIG. 5 illustrates positions or coordinates of a current limiting horn device. Xc is a horizontal distance between a vertical axis L of suspended insulators 3 and a current limiting horn 6, and Yc is a vertical distance between an earthing portion of the suspended insulators 3 and a tip end of the current limiting horn 6. In the same manner, Xp is a horizontal distance between the vertical axis of the suspended insulators 3 and a current limiting horn 5 on a charging side, and Yp is a vertical distance between a charging portion of the suspended insulators 3 and the current limiting horn 5.

TABLE 1

| | | Distance between horns | | Coordinates of horns (mm) | | | |
|---|---|---|---|---|---|---|---|
| | | Z (mm) | Z/Zo | Xc | Xp | Yc | Yp |
| Reference examples | (1) | 1100 | 75 | | | 250 | |
| | (2) | | | | | | |
| Reference examples | (3) | 970 | 66 | | | 380 | |
| | (4) | | | | | | |
| Embodiments of the present invention | (1) | | | 400 | 450 | | 110 |
| | (2) | | | | | | |
| | (3) | | | | | 650 | |
| | (4) | 700 | 48 | | | | |
| | (5) | | | 500 | 500 | 650 | 110 |
| | (6) | | | | | | |
| | (7) | | | 100 | 150 | 650 | 110 |
| | (8) | | | | | | |

Table 1 shows actual values of distance Z between the horns, Z/Zo and coordinates Xc, Xp, Yc and Yp of the horns of reference examples (1)–(4) and embodiments (1)–(8) of the invention where total lengths Zo of suspended insulators are constant (1,460 mm). Under the conditions shown in Table 1, voltages shown in Table 2 were applied between the horns 5 and 6 to measure probabilities of short-circuit between the horns and creepage along the suspended insulators. Table 2 shows the probabilities. As can be seen from the results in Table 2, when the ratio Z/Zo is 0.5 (the embodiments of the invention), the critical flash-over voltage can be increased to 2.8 times that of the prior art arcing horns. In this case, the critical flash-over voltage is one at which the flash-over occurs at 50% probability.

TABLE 2

| | | Critical flash-over voltage (KV) | Results (%) | | Ratio of critical flash-over voltage between arcing horns and current limiting horns |
|---|---|---|---|---|---|
| | | | Short-circuit between horns | Creepage along insulators | |
| Reference examples | (1) | +1375 | 0 | 100 | 1.38 |
| | (2) | −1410 | 0 | 100 | 1.88 |
| | (3) | +1375 | 15 | 85 | 2.05 |
| | (4) | −1410 | 15 | 85 | 2.10 |
| Embodiments of the present invention | (1) | +1375 | 100 | 0 | 2.73 |
| | (2) | +1595 | 80 | 20 | 3.16 |
| | (3) | −1410 | 100 | 0 | 2.80 |
| | (4) | −1640 | 70 | 30 | 3.25 |
| | (5) | +1375 | 90 | 10 | 2.73 |
| | (6) | −1410 | 95 | 5 | 2.80 |
| | (7) | +1375 | 80 | 20 | 2.73 |
| | (8) | −1410 | 70 | 30 | 2.80 |

Figures 2A, 2B, 2C, 2D:
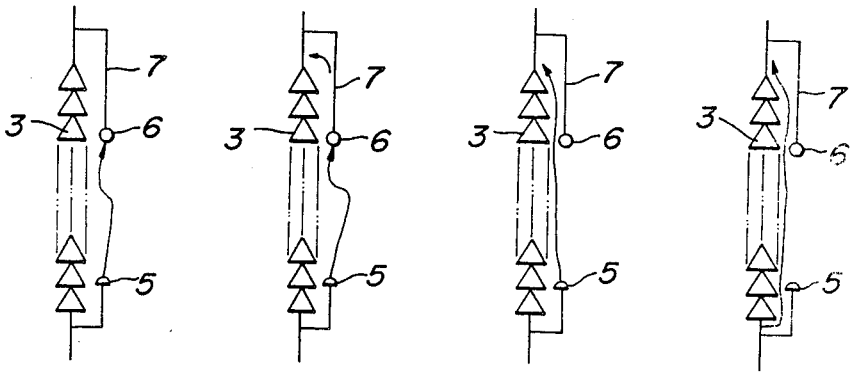

In the embodiments (1)–(3) of the invention, moreover, Xc is 400 mm and Xp is 450 mm as shown in Table 1. If these values are excessive as in the embodiments (5) and (6), the flash-over as shown in FIG. 2*d* is apt to occur. On the other hand, if these values are too small as in the embodiments (7) and (8), the flash-over as shown in FIG. 2*c* is apt to occur. The values of Xc and Xp are preferably 0.15Zo to 0.35Zo.

Although the resistance of non-linearity has been provided in the horn 6 on the earthing side in the above embodiment, this is only by way of example, and the resistance could be provided in the horn on the charging side or in both the horns on earthing and charging sides.

As can be seen from the above description, when extraordinary voltage caused by lightening surge is applied to a transmission line, the current limiting horn device provided thereon according to the invention securely causes the flash-over between horns to prevent any earthing accident which would otherwise occur in the transmission line.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A current limiting horn device for a transmission line supported by sets of insulators suspended from steel towers, said device including horns respectively arranged at charging and earthing portions of a respective set of insulators and spaced horizontally apart a predetermined distance from a vertical axis of the respective set of insulators, at least one of said horns being provided with an arrester element with a resistance having a non-linearity, wherein a ratio Z/Zo of a distance Z between said horns to a total length Zo of the respective set of insulators is not more than 0.5; and wherein a distance X between said vertical axis of said respective set of insulators and tip ends of said horns is in the range of $0.15Zo \leqq X \leqq 0.35Zo$.

2. A current limiting horn device as set forth in claim 1, wherein said arrester element is provided on said horn on the earthing side of the insulators.

3. A current limiting horn device as set forth in claim 1, wherein said arrester element is provided on said horn on the charging side of the insulators.

4. A current limiting horn device as set forth in claim 1, wherein said arrester elements are provided on both the horns.

* * * * *